US007756433B2

(12) United States Patent
Gross et al.

(10) Patent No.: US 7,756,433 B2
(45) Date of Patent: Jul. 13, 2010

(54) REAL TIME TRANSFER EFFICIENCY ESTIMATION

(75) Inventors: Eric M. Gross, Rochester, NY (US); Eric S. Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 318 days.

(21) Appl. No.: 12/013,733

(22) Filed: Jan. 14, 2008

(65) Prior Publication Data

US 2009/0180790 A1 Jul. 16, 2009

(51) Int. Cl.
*G03G 15/16* (2006.01)

(52) U.S. Cl. ..... 399/66; 399/49

(58) Field of Classification Search ..... 399/49, 399/66

See application file for complete search history.

(56) References Cited

U.S. PATENT DOCUMENTS 7,379,684 B2 * 5/2008 Julien ..... 399/49

* cited by examiner

*Primary Examiner*—Hoang Ngo
(74) *Attorney, Agent, or Firm*—Oliff & Berridge, PLC

(57) ABSTRACT

A method for identifying transfer efficiency in a xerographic print engine utilizes customer images, thereby avoiding the use of specialized images and the corresponding loss of productivity and paper waste. The method includes electronically sensing a two-dimensional residual mass structure on a substantial portion of a substrate surface within the xerographic print engine after image transfer, analyzing the two-dimensional structure using signal and/or image processing techniques, and determining the transfer efficiency, based on the sensed two-dimensional residual mass structure by applying the following functional equation form or variant: sensor_response=$[(1-M_{xfer_efficiency})*M_{pixelCnt}]+[(1-Y_{xfer_efficiency})*Y_{pixelCnt}]+[(1-C_{xfer_efficiency})*C_{pixelCnt}]+[(1-K_{xfer_efficiency})*K_{pixelCnt}]$.

21 Claims, 2 Drawing Sheets

REAL TIME TRANSFER EFFICIENCY ESTIMATION

BACKGROUND

Described herein is a method for determining the transfer efficiency of toner in a xerographic print engine. Transfer efficiency is the percent of toner that is transferred from a photoreceptor to a substrate. This information may be used to identify specific types of transfer defects. Upon identification, closed-loop control of the transfer process can be performed taking into account the identified transfer efficiency, to correct or compensate for defects.

Previous post-transfer residual mass sensors have provided information about the average transfer efficiency and could enable limited closed loop control of the transfer system. For example, an Extended Toner Area Coverage (ETAC) sensor may be used to measure residual mass per unit area (RMA) during xerographic setup. The data from the sensor in this case can be used to adjust the transfer setpoints to obtain optimal performance.

The information provided by measuring the RMA with a point sensor like an ETAC is limited to an average measurement of transfer performance. In addition, because a point sensor typically only measures the transfer efficiency at one isolated location in the cross process direction, variations that occur across the belt are not captured by this type of sensor. Therefore, typical ETAC sensors provide only minimal information that is relevant to control of the transfer performance.

Implementations may also use sensors containing arrays of optical sensing elements. In many of these devices, the array of sensing elements provides information across the entire surface of the photoconductor or other substrate of interest. Such optical sensing array devices are termed full-width array (FWA) sensors. These FWA sensors have been used for measuring RMA across all or a majority of the photoreceptor surface. This method allows the residual mass content of the entire image area of the photoreceptor to be captured. However, these implementations typically print predefined test targets, which are issued upon a cycle up or during routine maintenance or setup, and thus do not provide results of transfer efficiency of toner during runtime. During runtime, one cannot print predefined test targets without impacting customer productivity, both in terms of the image production rate and paper waste.

SUMMARY

In embodiments, described is a method for identifying transfer efficiency in a xerographic print engine, including electronically sensing a two-dimensional residual mass structure on a substantial portion of a substrate surface within the xerographic print engine after image transfer, analyzing the two-dimensional structure using signal and/or image processing techniques, and determining the transfer efficiency, based on the sensed two-dimensional residual mass structure by applying the following functional equation form: sensor_response=$[(1-M_{xfer_efficiency})*M_{pixelCnt}]+[(1-Y_{xfer_efficiency})**Y_{pixelCnt}]+[(1-C_{xfer_efficiency})*C_{pixelCnt}]+[(1-K_{xfer_efficiency})K_{pixelCnt}]$. In the latter, the notation "pixelCnt" refers to pixel count, and "xfer_efficiency" refers to transfer efficiency, which assumes a value from 0 to 1. For zero pixel counts, the sensor response output is assumed to be 0, otherwise a constant term can be added to the functional form. As described below, extensions of the latter functional form to account for image on image effects are also considered.

In further embodiments, described is a xerographic print engine, including a controller that receives an image signal representing an image to be printed, a photoconductive surface, a charging station that charges the photoconductive surface to a relatively high potential, an exposure station that receives image signals from the controller and records an electrostatic latent image on the photoconductive surface, a development station that deposits toner over the electrostatic latent image on the photoconductive surface to form a toner image, a transfer station that transfers the toner image from the photoconductive surface to a recording medium, a residual mass sensor that senses and outputs a two-dimensional residual mass structure of any residual mass remaining on the photoconductive surface useful to determine and quantify transfer efficiency of toner, the residual mass sensor being located adjacent the photoconductive surface downstream from the transfer station in a process direction and being capable of sensing a substantial portion of the photoconductive surface, and a signal processing routine that analyzes the output from the residual mass sensor and determines the transfer efficiency of toner based on the sensed two-dimensional residual mass by applying the following functional equation form: sensor_response $[(1-M_{xfer_efficiency})*M_{pixelCnt}]+[(1-Y_{xfer_efficiency})*Y_{pixelCnt}]+[(1-C_{xfer_efficiency})*C_{pixelCnt}]+[(1-K_{xfer_efficiency})*K_{pixelCnt}]$.

In still further embodiments, described is a method for identifying transfer efficiency in a xerographic print engine, including electronically sensing a two-dimensional residual mass structure on a substantial portion of a substrate surface within the xerographic print engine after each image transfer, analyzing the two-dimensional structure using sisal and/or image processing techniques, and determining the transfer efficiency, based on the sensed two-dimensional residual mass structure.

EMBODIMENTS

Figure 1:
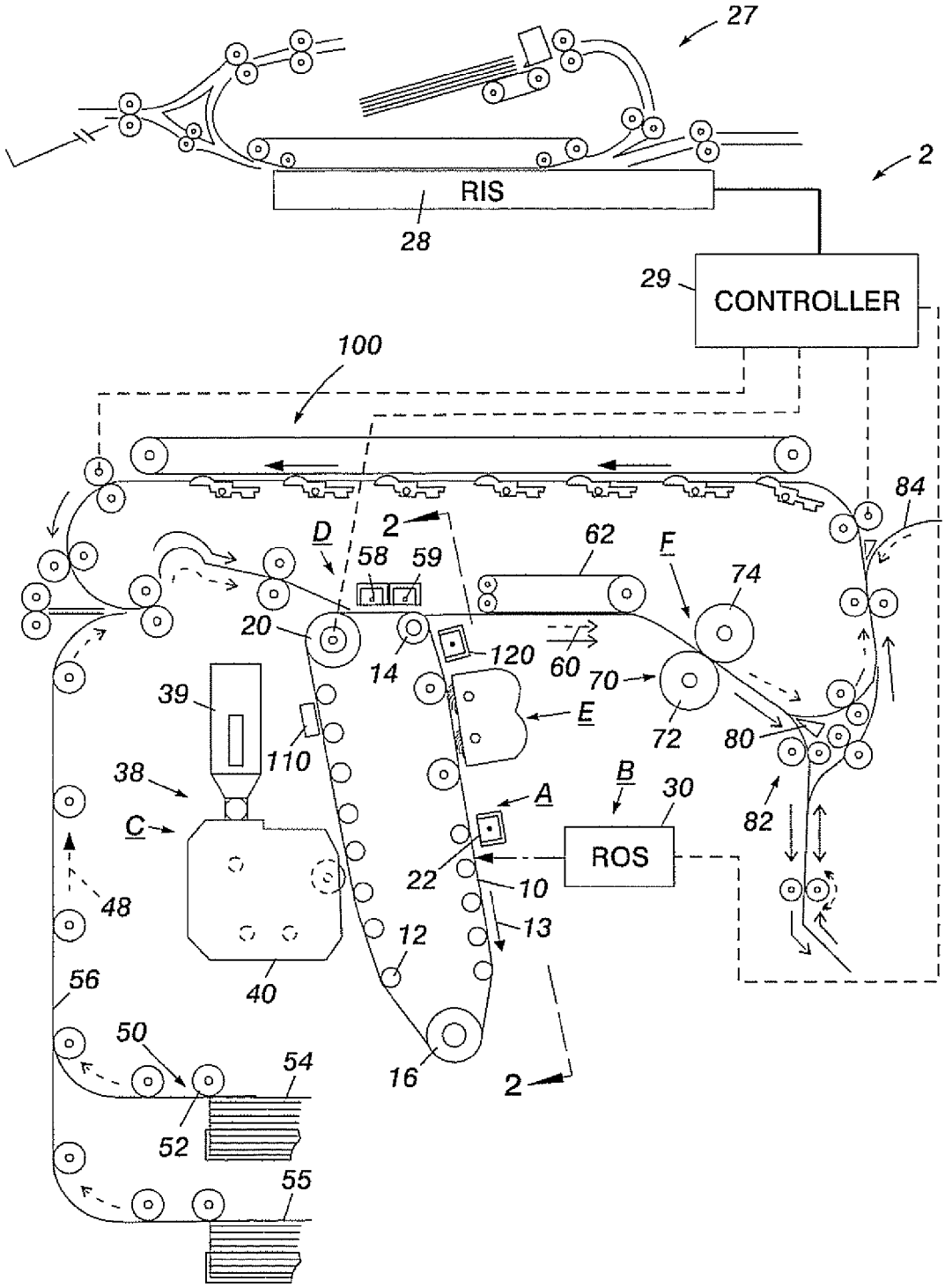
FIG. 1 illustrates a schematic of an exemplary xerographic print engine having a linear array optical sensor capable of two-dimensional residual mass sensing in a post-transfer location upstream of a cleaning station.

FIG. 1 schematically depicts an example electrophotographic (xerographic) printing machine 2 incorporating a residual mass sensor 120, such as a full-width array (FWA) sensor, that is capable of sensing the residual mass left on a photoreceptor post-transfer and generates a two-dimensional image of the residual mass pattern or structure remaining on the photoreceptor. It will become evident from the following discussion that the development system disclosed is not specifically limited in its application to the particular embodiment depicted.

Referring to FIG. 1, an original document is positioned in a document handler 27 on a raster input scanner (MIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic Subsystem (ESS) or controller 29 that controls a raster output scanner (ROS) 30 described below. Any other alteration system for capturing image data may also be used.

Electrophotographic printing machine 2 employs a photoconductive belt 10 for creating xerographic images. The photoconductive belt 10 may be comprised of any suitable material, known in the art or that may be developed. Belt 10 moves in the direction of arrow 13 to advance successive portions sequentially through the various processing stations disposed about the path of movement thereof. Belt 10 is entrained about idler roller 12, stripping roller 14, tensioning roller 16 and drive roller 20. As roller 20 rotates, it advances belt 10 in the direction of arrow 13. Alternative to the use of a belt, a drum or the like could be used.

Initially, a portion of the photoconductive surface passes through charging station A. At charging station A, a corona generating device indicated generally by the reference numeral 22 charges the photoconductive belt 10 to a relatively high, substantially uniform potential. However, any other suitable charging devices may also be used.

At an exposure station B, a controller or Electronic Subsystem (ESS), indicated generally by reference numeral 29, receives the image signals representing the desired output image and processes these signals to convert them to a continuous tone or grayscale rendition of the image. This is transmitted to a modulated output generator, for example a raster output scanner (ROS), indicated generally by reference numeral 30. In embodiments, ESS 29 is a self-contained, dedicated computer or control device. The image signals transmitted to ESS 29 may originate from a RIS as described above or from a computer, thereby enabling the electrophotographic printing machine to serve as a remotely located printer for one or more computers.

Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with a rotating polygon mirror block. The ROS imagewise discharges the photoconductive belt to record an electrostatic latent image thereon corresponding to the image received from ESS 29. As an alternative, ROS 30 may employ a linear array of Light Emitting Diodes (LEDs) arranged to illuminate the charged portion of photoconductive belt 10 on a raster-by-raster basis.

After the electrostatic latent image has been recorded on photoconductive belt 10, the belt advances to move the latent image to a development station C. At station C, toner, in the form of dry marking particles, is electrostatically attracted to the latent image. The latent image attracts toner particles from a developer apparatus, for example a scavengeless developer apparatus, resulting in a toner powder image being formed on the photoconductive surface of belt 10 (photoconductive surface 10). As successive electrostatic latent images are developed, toner particles are depleted from the developer material. A toner particle dispenser, indicated generally by reference numeral 39, on signal from controller 29, dispenses toner particles into a non-interactive development system, such as Hybrid Scavengeless Developer (HSD) system 40 of developer unit 38 available from Xerox Corporation. Developer unit 38 comprises donor roll 41 that serves to deposit toner particles on the photoconductive surface 10.

Developer system 40 may alternatively comprise a non-interactive development system comprising a plurality of electrode wires closely spaced from a toned donor roll or belt in the development zone. An AC voltage is applied to the wires to generate a toner cloud in the development zone. The electrostatic fields associated with the latent image attract toner from the toner cloud to develop the latent image. The donor roll 41 may also comprise an electrode donor roll.

With continued reference to FIG. 1, after the electrostatic latent image is developed, the toner powder image present on belt 10 advances to transfer station D. A substrate 48, such as plain paper, transparency and the like, is advanced to a transfer station D by a substrate feeding apparatus 50. In embodiments, substrate feeding apparatus 50 includes a feed roll 52 contacting the uppermost substrate of stack 54. Feed roll 52 rotates to advance the uppermost substrate from stack 54 into vertical transport 56. Vertical transport 56 directs the advancing substrate 48 of support material into registration transport 57 past image transfer station D to receive an image from photoreceptor belt 10 in a timed sequence so that the toner powder image formed thereon contacts the advancing substrate 48 at transfer station D.

Transfer station D includes a corona generating device 58 or the like that sprays ions onto the back side of substrate 48. This attracts the toner powder image from photoconductive surface 10 to substrate 48. After transfer, substrate 48 continues to move in the direction of arrow 60 by way of belt transport 62, which advances substrate 48 past transfer device 58. A detack corona device 59 positioned downstream of the transfer device 58 serves to lessen the electrostatic attraction between the substrate 48 and the belt 10 to thereby facilitate stripping of the substrate 48 from the belt in the area of the stripping roller 14.

Fusing station F includes a fuser assembly indicated generally by reference numeral 70, which permanently affixes the transferred toner powder image to the copy substrate. In embodiments, fuser assembly 70 includes a heated fuser roller 72 and a pressure roller 74 with the powder image on the copy substrate contacting fuser roller 72.

As the substrates 48 pass through fuser 70, images are permanently fixed or fused to the substrates. After passing through fuser 70, a gate 80 either allows the substrate to move directly via output 84 to a finisher or stacker, or deflects the substrate into the duplex path 100, specifically, first into single substrate inverter 82. That is, if the substrate is either a simplex substrate, or a completed duplex substrate having both side one and side two images formed thereon, the substrate will be conveyed via gate 80 directly to output 84. However, if the substrate is being duplexed and is then only printed with a side one image, the gate 80 will be positioned to deflect that substrate into the inverter 82 and into the duplex loop path 100, where that substrate will be inverted and then fed for recirculation back through transfer station D and fuser 70 for receiving and permanently fixing the side two image to the backside of that duplex substrate, before it exits via exit path 84.

After the print substrate is separated from photoconductive surface 10, any residual toner/developer and paper fiber particles adhering to photoconductive surface 10 are removed therefrom at cleaning station E. Cleaning station E includes one or more rotatably mounted fibrous brushes and a cleaning blade in contact with photoconductive surface 10 to disturb and remove paper fibers and non-transferred toner particles. The blade may be configured in either a wiper or doctor position, depending on the application. Subsequent to cleaning, a discharge lamp (not shown) floods photoconductive surface 10 with light to dissipate any residual electrostatic charge remaining thereon prior to the charging thereof for the next successive imaging cycle.

The various machine functions are regulated by controller 29. In embodiments, the controller is a programmable microprocessor which controls all of the machine functions hereinbefore described including toner dispensing. The controller provides a comparison count of the copy substrates, the number of documents being recirculated, the number of copy substrates selected by the operator, time delays, jam corrections, etc. The control of all of the exemplary systems heretofore described may be accomplished by conventional control switch inputs from the printing machine consoles selected by the operator. Conventional substrate path sensors or switches may be utilized to keep track of the position of the document and the copy substrates.

A density sensor, such as an Extended Toner Area Coverage (ETAC) sensor 10 downstream of the developer unit 38, is used for controlling actuators within the development subsystem. Examples of such actuators include development bias voltage, laser power, and charging voltage/current or some combination/subset of these.

Figure 2:
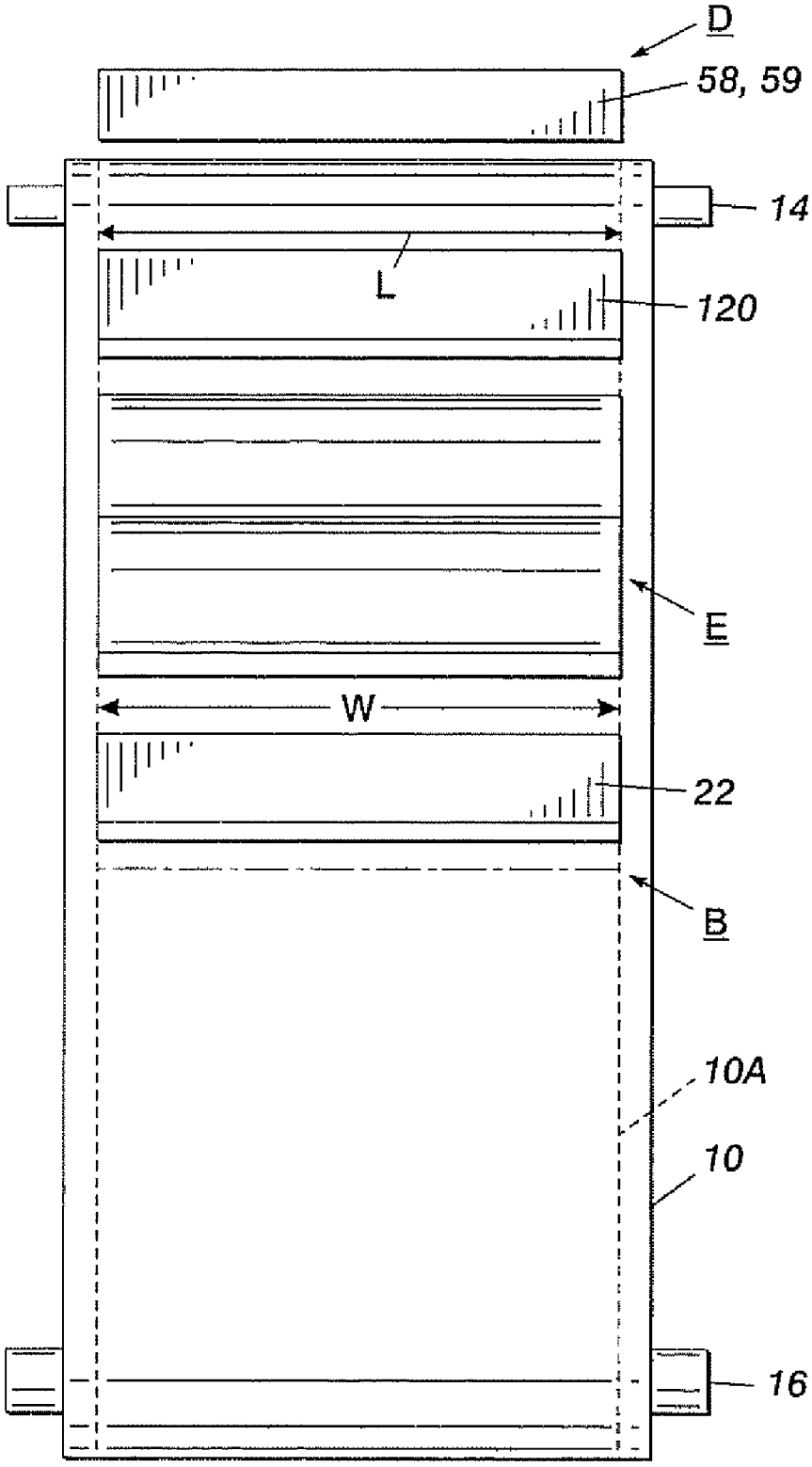
FIG. 2 illustrates a partial cross-sectional view of the xerographic print engine of FIG. 1 taken alone lines 3-3 showing relevant details of the transfer station, photoconductive belt and residual mass sensor.

As mentioned above, transfer efficiency is the percent of toner that is transferred from a photoreceptor to a substrate. This information may be used to identify specific types of transfer defects. Upon identification, closed-loop control of the transfer process can be performed taking into account the identified transfer efficiency, to correct or compensate for defects. In order to provide improved determination of transferred toner, a FWA 120 is provided downstream of transfer station D, prior to cleaning station E. The FWA 120 having an array length L that spans substantially the entire effective width W of the photoconductive surface 10 (that is, the portion 10A that is capable of being imaged by the charging station A, exposure station B, and developer station C) as shown in FIG. 2.

The FWA 120 measures the toner mass left on a photoreceptor or other substrate surface after transfer by transfer station D to obtain an average residual mass per unit area (RMA) level to determine a loss in average transfer efficiency.

With 100% transfer efficiency, the FWA 120 measurement of an image will equate to a clean belt read, which can be represented as a discrete voltage response surface over the photoreceptor 10 plane. For this discussion, it will be assumed that any discrepancy between the FWA 120 output and the clean belt read is indicative of a presence of untransferred toner, excluding typical issues of sensor drift, variation due to random noise and the like. Thus, for the purposes of the discussion below, any FWA 120 read discrepancy with a clean belt will be assumed to be due to the presence of un-transferred toner. This assumption can be accounted for in practical applications by means of a clean belt calibration strategy. For example, the photoreceptor may be run multiple times with development station(s) off and with cleaning on to ensure no toner is present. Thereafter, a sensor records the clean belt read and uses that value as a calibration point for a zero toner mass level. Such calibration schemes may be run in real time or during cycle up or cycle down. The frequency is often either preprogrammed or the event is triggered if a set of clean belt reads differs from those previously recorded by a pre-specified threshold.

The output from FWA 120, over relatively low toner mass levels, that is, levels expected at post transfer, is the linear supposition of the residual masses due to all separations that may be present, for example, magenta, yellow, cyan and black (M, Y, C and K). The FWA 120 used cannot distinguish between the relative contributors (otherwise significant complimentary optical filtering would be required resulting in essentially individual sensors for each separation), that is, how much residual mass is "M" toner, how much is "Y" toner, how much is "C" toner, and how much is "K" toner. A pixel count of each image is readily available in the image file, and thus can be exploited to determine relative contributions. Therefore, with the knowledge of the pixel count, the following algorithmic equation is used to determine the relative contributions, that is, the transfer efficiency of toner:

$$FWA_response=[(1-M_{xfer_efficiency})*M_{pixelCnt}]+[(1-Y_{xfer_efficiency})*Y_{pixelCnt}]+[(1-C_{xfer_efficiency})*C_{pixelCnt}]+[(1-K_{xfer_efficiency})*K_{pixelCnt}]$$

From the above relationship, the FWA_response and the pixel counts (pixelcnt) are known per panel, that is, per sheet. Thus, a least squares estimation can be made of $M_{xfer_efficiency}$, $Y_{xfer_efficiency}$, $C_{xfer_efficiency}$, and $K_{xfer_efficiency}$. The later parameters (constrained to be positive), serve to act as estimates for actual transfer efficiency. Here the term FWA_ response is a measure of the discrepancy between a clean belt response and a measured response.

Although many models are possible, for this discussion, the overall model has two distinct interpretations: 1) a "lumped" model and 2) a "spatial" model.

For the lumped case, the transfer efficiency parameters are scalar quantities that represent average transfer efficiency of each separation over the entire photoreceptor 10 at a particular instance in time, and the FWA 120 response is "lumped" by converting the 2-D response surface to a single metric, for example, by computing the average discrepancy or computing a magnitude weighted average discrepancy.

Because the FWA 120 response provides a 2-D profile of the photoreceptor and because the pixel count also contains 2-D information, the estimation model described above can also be treated in a spatial sense. For this "spatial" version of the model, the transfer efficiency parameters become matrices, where each element in the matrix is an estimated transfer efficiency at a particular grid element on the photoreceptor 10 at a particular instance in time.

In embodiments, additional models beyond the lumped and spatial models described above can also be proposed. For example, to take into account image-on-image (IOI) effects, a model with ten terms corresponding to the ten 101 possibilities shown in the following table, if the color order is M, Y, C, and K may be:

| Single Layer | Double Layer | Triple Layer | Four Layer |
|---|---|---|---|
| M | Y + M | C + Y + M | K + C + Y + M |
| Y | C + Y | K + C + Y | |
| C | K + C | | |
| K | | | |

One of ordinary skill in the art will appreciate that if more than four colors are used, more terms may be added as required.

Also, to improve the precision of the estimates, the FWA_ response may be constrained to only those locations at which pixels were rendered for each color. That is, if from image path information there was no intent to develop, for example, magenta at certain locations, then the FWA will not process output at those locations, thereby limiting the injection of clean belt noise. A benefit will be that signal noise will be improved.

In embodiments, a form of "forgetting factor" that progressively discounts data as it recedes into the past may be applied because the transfer efficiency is expected to change over time. In this way, past data is discounted as being less relevant to parameter estimation because the transfer efficiency shifts slowly over time due to material and environmental changes. An illustrative example of a "forgetting factor" is explained in detail below. In embodiments, the above algorithm can be implemented recursively or in the periodic batch mode that was described above.

A determination of transfer efficiency for one print is considered one read. In embodiments, the minimum number of reads within a batch is equal to the number of the different types of toners being measured, that is, the number of unknown coefficients. For example, if the toners being measured are M, Y, C and K, the number of reads within the batch would be at least four. Determining the maximum number of reads within a batch, which can be any number above the minimum requirement, is a tradeoff. For example, each machine has short term drift and long term drift in relation to the transfer efficiency. Therefore, the more reads required to be within a batch before the transfer efficiency is determined, the less likely it will be to recognize short-term drift. For example, say a certain machine requires, 100 reads within a batch. Thus, as a new read is accounted for, it is placed into the batch and the oldest read is dropped out. That is, the most current, 100 reads are maintained. However, because the amount of reads within the batch is so high, even if the next 10 reads indicate a major shift for the worse in toner efficiency, the overall average will only be slightly effected because 10 reads are only 10 percent of the overall reads.

In an example where no forgetting factor is used and a fixed batch size of N+1 is utilized, that is, there are N+1 instances in a batch, the batch may behave as a buffer with a first in first out (FIFO) policy. Therefore, with a term model (M, C, Y and K), suppose the data is collected as a set of N+1 instances, and as each new panel arrives at time k, the least current data at time k−N−1 is removed, thereby maintaining a set of N+1 data sets that advances in time. The term k is actual time assumed to be represented as a sequence of integers. Then we have at each time instant:

$$\text{FWA_response}(k-N) = \begin{array}{c} [(1-M_{xfer_efficiency})*M_{pixelCnt}(k-N)] + \\ [(1-Y_{xfer_efficiency})*Y_{pixelCnt}(k-N)] + \\ [(1-C_{xfer_efficiency})*C_{pixelCnt}(k-N)] + \\ [(1-K_{xfer_efficiency})*K_{pixelCnt}(k-N)] \end{array}$$

$$*$$

$$\text{FWA_response}(k-N+1) = \begin{array}{c} [(1-M_{xfer_efficiency})*M_{pixelCnt}(k-N+1)] + \\ [(1-Y_{xfer_efficiency})*Y_{pixelCnt}(k-N+1)] + \\ [(1-C_{xfer_efficiency})*C_{pixelCnt}(k-N+1)] + \\ [(1-K_{xfer_efficiency})*K_{pixelCnt}(k-N+1)] \end{array}$$

$$*$$

$$*$$

$$*$$

$$\text{FWA_response}(k) = \begin{array}{c} [(1-M_{xfer_efficiency})*M_{pixelCnt}(k)] + \\ [(1-Y_{xfer_efficiency})*Y_{pixelCnt}(k)] + \\ [(1-C_{xfer_efficiency})*C_{pixelCnt}(k)] + \\ [(1-K_{xfer_efficiency})*K_{pixelCnt}(k)] \end{array}$$

In a matrix notation, the left hand column can be expressed as the N+1 by 1 vector FWA. The coefficients to be estimated over the time span k to k−N, $M_{xfer_efficiency}$, $Y_{xfer_efficiency}$, $C_{xfer_efficiency}$ and $K_{xfer_efficiency}$) form a 4 by 1 vector termed Xfer_efficiency. The pixel count data forms a N+1 by 4 matrix $\phi$. Following a standard least squares approach, the transfer efficiency estimates would be given by Xfer_Efficiency= $(\phi^T\phi)^{-1}\phi^T$ FWA, and confidence bounds on the estimates determined accordingly. One of ordinary skill in the art will appreciate the analytical aspects of this approach and the inclusion, if any, of a forgetting factor, as this is common in the art. Thus, because the pixel count requests are not within the control of the algorithm but rather is customer determined, that is, determined by the image the customer chooses to render, the inverse of $(\phi^T\phi)^{-1}$ may not exist, in which case a pseudo inverse would be necessary and would result in an estimation of a linear combination of transfer efficiency coefficients (if the rank of $\phi$ is p, then p linear combinations of the coefficients can be estimated). This would occur, for example, if the customer is running the same or a few documents repeatedly and thus the pixel count variation is excessively restricted. The knowledge of the individual coefficients may not be necessary. Bounds can be set on various combinations of coefficients and, if exceeded, calls for actions can be initiated. If bounds on various linear combinations exceed thresholds, a diagnostic routine may be used to actively vary the pixel counts and identify the individual coefficients, and hence the separation(s) that are the primary contributors.

As mentioned, using the above algorithm to obtain the transfer efficiency of toner is done in a closed loop format, in real time. Thus, the transfer efficiency related to each print rendered may be obtained. The ability to obtain the transfer efficiency upon every print rendered allows for a more accurate understanding of the transfer efficiency of the toner. How many samples, that is, transfer efficiency reads, that are to be obtained is only restricted by how many prints are rendered and how fast a particular print engine can render the prints, that is, what the pages per minute (ppm) that particular print engine is capable of. In embodiments, the above method can sample the amount of prints rendered or less. If, for example, a print engine is capable of 100 ppm, the above method can obtain up to 100 transfer efficiency reads per minute.

Knowledge of the transfer efficiency in real time, not only accounts for a more accurate transfer efficiency read, it allows for the ability to automatically adjust parameters, such as contact pressure, entry and exit transfer nip geometry, material toner concentration, and the transfer current to counteract performance degradation in real time. Thus, if the transfer efficiency is shown to be poor, changes can be made to the parameters to fix the problem. For example, in the explanation above, it was assumed that a clean belt read provided that 100% of toner was transferred. Keeping with that assumption, say for example, the above method provided information that the transfer efficiency is 90%. If 90% is an acceptable amount requiring no chance, the process continues unchanged or with slight parameter alterations. If, however, the process provides information that 80% is the transfer efficiency and such is unacceptably low, adjustments to the parameters are made to counteract the poor transfer efficiency and thus bring the device back to an acceptable level of toner being transferred. In embodiments, the transfer efficiency may be so low, for example, 50%, that the print engine may indicate that a service call is needed. This indication may be made to the user, or if the print engine is on a network, the device may initiate the service call. In further embodiments, the print engine on the network may maintain a communication with a manufacturer allowing the manufacturer to log the transfer efficiency of the print engine in order to better understand how the product is working.

In the illustrative examples above, there is only a single transfer step. In embodiments, tandem engines may be used and thus there are two transfer steps. A first transfer is from the photoconductor surface to an intermediate substrate (typically a belt). After all four color images are transferred to this intermediate belt, the entire image is then transferred to paper in a second transfer step. Thus, it may be desirable to sense the percent of toner transferred after either or both of these steps.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for identifying transfer efficiency in a xerographic print engine, comprising:

electronically sensing a two-dimensional residual mass structure on a substantial portion of a substrate surface within the xerographic print engine after image transfer;

analyzing the two-dimensional structure using signal and/or image processing techniques; and determining the transfer efficiency, based on the sensed two-dimensional residual mass structure by applying the following functional equation form: sensor_response=$[(1-M_{xfer_efficiency})*M_{pixelCnt}]+[(1-Y_{xfer_efficiency})*Y_{pixelCnt}]+[(1-C_{xfer_efficiency})*C_{pixelCnt}]+[(1-K_{xfer_efficiency})*K_{pixelCnt}]$.

2. The method according to claim 1, wherein the sensing is performed using a full width array sensor that spans substantially an entire width of the substrate surface.

3. The method according to claim 1, further comprising providing feedback to the print engine to adjust a subsequent printing operation based on the transfer efficiency determined.

4. The method according to claim 3, wherein adjusting the subsequent printing operation comprises adjusting at least one of a central pressure, an entry and exit transfer geometry and/or a transfer current.

5. The method according to claim 1, wherein identifying the transfer efficiency is executed after every image transfer.

6. The method according to claim 1, wherein the determined transfer efficiency is stored in a batch that maintains the determined transfer efficiencies.

7. The method according to claim 6, wherein the number of the determined transfer efficiencies stored in the batch is equal to the number of different types of toners being transferred.

8. The method according to claim 1, wherein transfer efficiency parameters are expressed as a vector, wherein each element is an estimated transfer efficiency at a particular grid element on a photoreceptor at a particular instance in time.

9. The method according to claim 1, wherein transfer efficiency parameters are scalar quantities that represent average transfer efficiency of each separation over an entire photoreceptor at a particular instance in time.

10. A xerographic print engine, comprising:

a controller that receives an image signal representing an image to be printed;

a photoconductive surface;

a charging station that charges the photoconductive surface to a relatively high potential;

an exposure station that receives image signals from the controller and records an electrostatic latent image on the photoconductive surface;

a development station that deposits toner over the electrostatic latent image on the photoconductive surface to form a toner image;

a transfer station that transfers the toner image from the photoconductive surface to a recording medium;

a residual mass sensor that senses and outputs a two-dimensional residual mass structure of any residual mass remaining on the photoconductive surface useful to determine and quantify transfer efficiency of toner, the residual mass sensor being located adjacent the photoconductive surface downstream from the transfer station in a process direction and being capable of sensing a substantial portion of the photoconductive surface; and a signal processing routine that analyzes the output from the residual mass sensor and determines the transfer efficiency of toner based on the sensed two-dimensional residual mass by applying the following functional equation form: sensor_response=$[(1-M_{xfer_efficiency})*M_{pixelCnt}]+[(1-Y_{xfer_efficiency})*Y_{pixelCnt}]+[(1-C_{xfer_efficiency})*C_{pixelCnt}]+[(1-K_{xfer_efficiency})*K_{pixelCnt}]$.

11. The xerographic print engine according to claim 10, further comprising a feedback control that adjusts at least one operating parameter of the xerographic print engine based on the transfer efficiency determined.

12. The xerographic print engine according to claim 10, wherein the feedback control adjusts an actuator associated with the transfer station.

13. The xerographic print engine according to claim 10, wherein the actuator is at least one of a central pressure, an entry and exit transfer geometry and a transfer current.

14. The xerographic print engine according to claim 10, wherein the residual mass sensor is a full-width array sensor.

15. The xerographic print engine according to claim 10, wherein the signal process routine stores a batch of the determined transfer efficiencies.

16. The xerographic print engine according to claim 15, wherein the batch includes a number of determined transfer efficiencies equal to the number of different types of toners being transferred.

17. A method for identifying transfer efficiency in a xerographic print engine, comprising:

electronically sensing a two-dimensional residual mass structure on a substantial portion of a substrate surface within the xerographic print engine after each image transfer, wherein the sensing is performed during formation of actual, non-test images during runtime of the xerographic print engine, and the sensing is performed using a full width array sensor that spans substantially an entire width of the substrate surface;

analyzing the two-dimensional structure using signal and/or image processing techniques; and determining the transfer efficiency, based on the sensed two-dimensional residual mass structure.

18. The method according to claim 17, wherein transfer efficiency is determined by applying the following functional equation form: sensor_response=$[(1-M_{xfer_efficiency})**M_{pixelCnt}]+[(1-Y_{xfer_efficiency})*Y_{pixelCnt}]+[(1-C_{xfer_efficiency})C_{pixelCnt}]+[(1-K_{xfer_efficiency})*K_{pixelCnt}]$.

19. The method according to claim 17, further comprising providing feedback to the print engine to adjust at least one operating parameter of the xerographic print engine based on the transfer efficiency determined.

20. The method according to claim 19, wherein the at least one operating parameter is selected from the group consisting of a central pressure, an entry and exit transfer geometry and a transfer current.

21. The method according to claim 17, wherein the determined transfer efficiency is stored in a batch that maintains the most recent number of determined transfer efficiencies, wherein the number of determined transfer efficiencies stored is equal to the number of different toner being transferred.

* * * * *